US012270328B2

(12) United States Patent
Cote et al.

(10) Patent No.: US 12,270,328 B2
(45) Date of Patent: Apr. 8, 2025

(54) COOLING FAN ASSEMBLY WITH WATER FORDING FEATURES

(71) Applicant: Robert Bosch GmbH, Stuttgart (DE)

(72) Inventors: Frederick R. Cote, Dover, MA (US); Mark Bilodeau, Dover, MA (US)

(73) Assignee: Robert Bosch GmbH, Stuttgart (DE)

( * ) Notice: Subject to any disclaimer, the term of this patent is extended or adjusted under 35 U.S.C. 154(b) by 122 days.

(21) Appl. No.: 18/040,046

(22) PCT Filed: Jul. 26, 2021

(86) PCT No.: PCT/EP2021/070889
§ 371 (c)(1),
(2) Date: Jan. 31, 2023

(87) PCT Pub. No.: WO2022/023285
PCT Pub. Date: Feb. 3, 2022

(65) Prior Publication Data

US 2023/0272733 A1 Aug. 31, 2023

Related U.S. Application Data

(60) Provisional application No. 63/059,515, filed on Jul. 31, 2020.

(51) Int. Cl.
*F01P 5/04* (2006.01)
*F01P 5/02* (2006.01)
(Continued)

(52) U.S. Cl.
CPC *F01P 5/04* (2013.01); *F01P 5/02* (2013.01); *F04D 25/06* (2013.01); *F04D 29/329* (2013.01);
(Continued)

(58) Field of Classification Search
CPC ..... F01P 5/04; F01P 5/02; F01P 2005/046; F04D 25/06; F04D 29/329; F04D 29/522;
(Continued)

(56) References Cited

U.S. PATENT DOCUMENTS

2009/0136341 A1* 5/2009 Kenyon ..... F04D 25/0606 415/203
2018/0371979 A1* 12/2018 Takeuchi ..... F04D 29/522
2019/0195232 A1* 6/2019 Sakurada ..... H02K 7/14

FOREIGN PATENT DOCUMENTS

JP 2005147018 * 6/2005
JP 2005147018 A 6/2005
WO 2008146154 A2 12/2008

OTHER PUBLICATIONS

English translation of JP2005147018 generated from Espacenet website on Jul. 22, 2024 (Year: 2024).*
(Continued)

*Primary Examiner* — Bryan M Lettman
(74) *Attorney, Agent, or Firm* — Michael Best & Friedrich LLP

(57) ABSTRACT

An automotive cooling fan assembly includes fan driven by a motor. The motor supported by a motor support structure of a shroud. The motor support structure includes a motor carrier and support arms extend radially outward from an outer surface of the motor carrier. The fan includes a central hub and blades that extend radially outward from the side of the hub. An axial operating gap is disposed between an end of the hub and the motor support structure. The motor support structure includes a protrusion that protrudes axially into the operating gap and serves to govern an extent of deflection of the fan during a water fording event.

25 Claims, 10 Drawing Sheets

(51) Int. Cl.

| | |
|---|---|
| ***F04D 25/06*** | (2006.01) |
| ***F04D 29/32*** | (2006.01) |
| ***F04D 29/52*** | (2006.01) |
| ***F04D 29/60*** | (2006.01) |

(52) U.S. Cl.
CPC ..... *F04D 29/522* (2013.01); *F04D 29/601* (2013.01); *F01P 2005/046* (2013.01)

(58) Field of Classification Search
CPC .... F04D 29/601; F04D 29/325; F04D 29/403; F04D 29/52
See application file for complete search history.

(56) References Cited

OTHER PUBLICATIONS

International Search Report and Written Opinion for Application No. PCT/EP2021/070889 dated Oct. 21, 2021 (9 pages).

* cited by examiner

COOLING FAN ASSEMBLY WITH WATER FORDING FEATURES

CROSS REFERENCE TO RELATED APPLICATIONS

This application is a 371 National Phase of PCT Application No. PCT/EP2021/070889 filed Jul. 26, 2021, which claims priority to U.S. Provisional Patent Application No. 63/059,515, filed Jul. 31, 2020, the entire contents of which are hereby incorporated by reference herein in their entirety.

BACKGROUND

Automotive cooling fan assemblies are designed to move a flow of cooling air through a heat exchanger. Since automobiles may be operated in all weather, road conditions, and terrains, the situation where a vehicle encounters a "water hazard" may arise.

When a vehicle encounters a water hazard, the depth of the water encountered may be sufficient to immerse all or part of the fan blade as the vehicle traverses or "fords" the water hazard.

If the fan is operating during "fording", the rotating blades will create hydrodynamic-lift (akin to a boat propeller) as they enter the water. Since water is approximately 800 times more dense than air, the lift-force generated by the submerged fan blade will be approximately 800 times greater than during "normal" in-air operation. With this significantly greater thrust force, there will be a commensurate greater axial deflection of the fan relative to the structures surrounding it. In particular, there is a risk of the fan blade deflecting sufficiently upstream to contact the heat exchanger. If the fan contacts the heat exchanger, there is a risk of puncture which could lead to the vehicle becoming inoperable.

Factors that increase the likelihood of an operating fan contacting the beat-exchanger during water fording include: high water depth, high fan rotation speed, rapid immersion, axially-compliant fan blades, large fan diameter, and limited axial distance between the fan and the heat-exchanger.

Countermeasures that may be employed to limit water-fording induced fan deflection include (i) motor-overload detection, in which the motor is switched off in the event upon detection of high loads associated with encountering water, (ii) incorporation of stationary obstructions between the fan and the heat-exchanger that will prevent the deflecting blade from contacting the heat-exchanger and (iii) incorporation of axially stiff fan blades.

The downside of using motor-overload detection is that if the fan immersion is sufficiently rapid, the fan's inertia will be sufficient to maintain fan rotation for a time without power supplied to the motor. As long as the fan is rotating, contact with the heat exchanger is possible.

The downside of incorporating upstream obstructions is the potential of the obstruction to create unwanted noise during normal operation, the potential for fan blade breakage when and if the fan blade contacts the obstruction, and additional complexity of incorporating the obstruction into typical injection molded shroud tools.

The downside of incorporating axially stiff fan blades is the additional weight and material cost, and possible loss in aerodynamic efficiency that comes with thickened blades.

It is desirable to provide an automotive cooling fan assembly that prevents damage to the heat exchanger due to excessive fan deflection during a water fording event, and avoids the downsides mentioned above.

SUMMARY

When the fan assembly encounters water during a water fording event, the fan blades that normally operate in air, will operate in water. At least initially, the "typical" fording event involves a water depth that does not reach above the fan centerline, the hydrodynamic force is limited to the lower two quadrants of the fan disk. Operation in water greatly increases the axially directed thrust (e.g., thrust directed in a direction parallel to the fan rotational axis) on the submerged portion of the fan, including any submerged blades or partially submerged blades, by the ratio of the density of water to the density of air. As a result, the thrust on the submerged blades is approximately 800 times greater than the thrust on the blades that are not submerged. This force imbalance may lead to deflection of the fan blades, deflection of the motor carrier and/or motor shaft, deformation of the fan hub and/or deflection of the hub about a horizontal pivot axis that is perpendicular to the rotational axis of the fan. For example, the hub may deflect about the pivot axis when submerged portions of the rotating fan deflect in the upstream direction (e.g. toward the heat exchanger, see FIG. 15).

In some embodiments, the deflection of the fan acts to increase the axial operating gap between the fan hub and the adjacent motor-support structure at locations below the pivot axis and decrease the operating gap between the fan hub and the adjacent motor-support structure at locations above the pivot axis. When the pivoting moment becomes sufficiently large, portions of the fan hub disposed above the pivot axis can contact the adjacent motor-support structure.

When contact between the hub 22 and the motor support structure occurs, further upstream axial deflection of the submerged portion of the fan is limited because the stationary shroud structure adds mechanical support to the fan. Additionally, the friction created by the contact between the rotating fan and the stationary shroud motor-support structure provides braking action that may slow the fan's rotational speed. Since the axial force is proportional to the square of the fan speed, this braking action acts to further limit the upstream axial deflection of the submerged portion of the fan.

The fan assembly disclosed herein leverages the pivot-moment water-fording behavior to limit fan deflection during vehicle water-fording. The shroud motor-support structure is designed so that a shroud feature creates an intentionally limiting axial clearance gap in the vicinity of the vertical axis at locations above the pivot axis, whereby the risk of the fan contacting and damaging the vehicle heat exchanger is reduced.

In some embodiments, the motor support structure is provided with a protrusion that results in a limiting axial clearance gap that, in turn, will result in contact between the hub and the motor support structure during fording and before the fan blade can deflect sufficiently far upstream to contact the heat exchanger, and by limiting the circumferential extent of the protrusion, deleterious effects (such as insufficient motor cooling, or increased possibility of rubbing during normal operation) associated with an axial clearance gap that is too small may be minimized.

In addition to preventing damage to the heat exchanger during a water-fording event, the fan assembly disclosed herein may have the following advantages: (i) motor-overload detection is not required to reduce axial deflection; (ii)

no upstream obstruction is required; and (iii) fan design tradeoffs between aerodynamic efficiency and structural robustness may be/eliminated.

DETAILED DESCRIPTION

Figure 15:
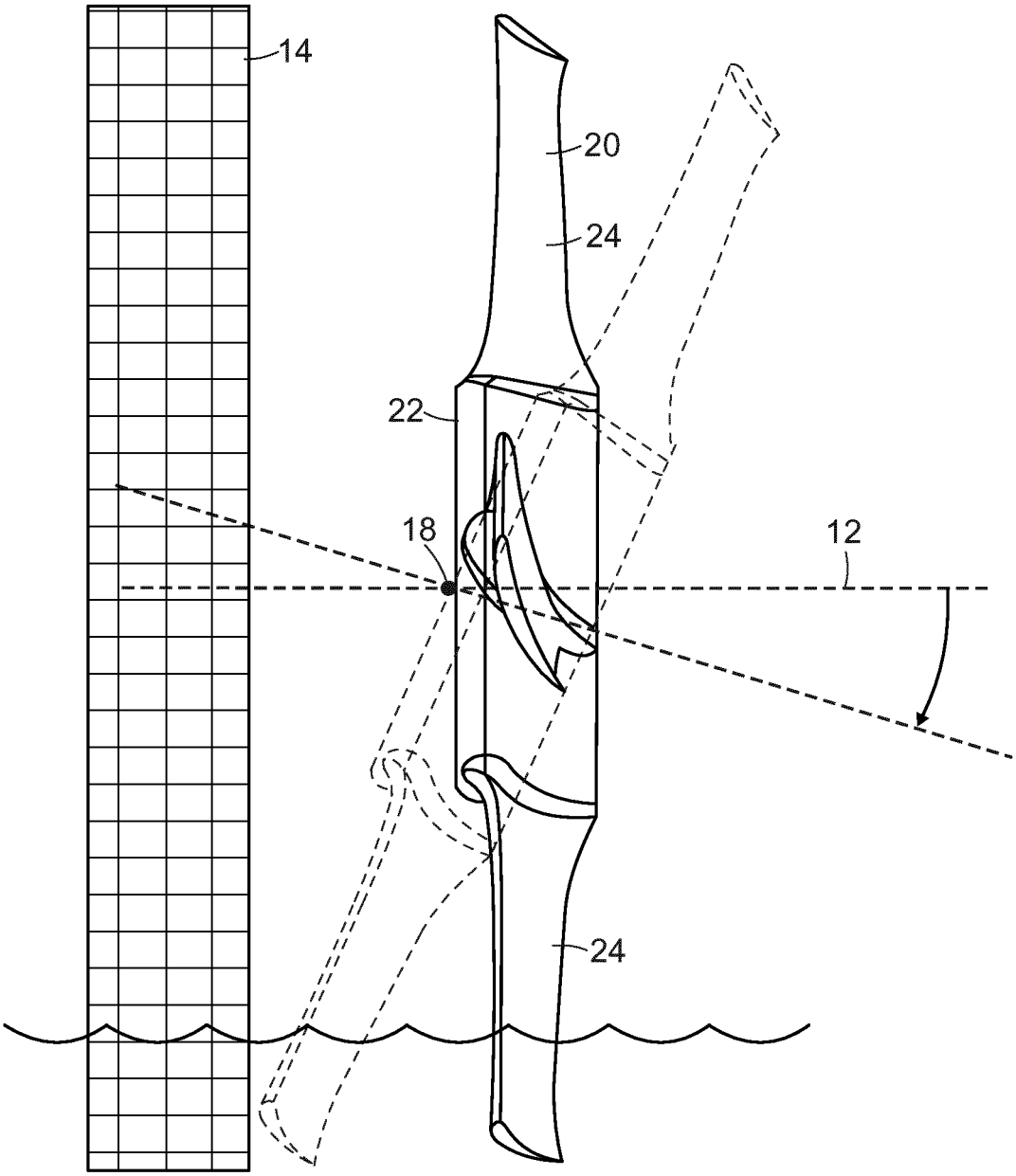
FIG. 15 is an illustration of a portion of a vehicle cooling system illustrating the relative position and orientation of a fan relative to a heat exchanger during normal fan operation (solid lines), and shows the relative position and orientation of the fan relative to the heat exchanger as deflected during a water fording event (broken lines).

Referring to FIGS. 1-5, a fan assembly 1 of the type used to cool vehicle heat exchangers includes a fan 20, a motor 30 that drives the fan 20 to rotate about a rotational axis 12, and a shroud 40 that supports the fan 20 and motor 30 with respect to a heat exchanger 14 (shown in FIG. 15). The shroud 40 is configured to be coupled to the heat exchanger 14 in a "pull through" configuration, such that the fan 20 draws airflow through the heat exchanger 14. In the figures, the direction of air flow through the fan assembly 1 is represented by an arrow having reference number 10. Alternatively, the fan assembly 1 may be coupled to the heat exchanger 14 in a "pusher" configuration (not shown), such that the fan 20 discharges an airflow through the heat exchanger.

As used herein, the terms "upstream" and "downstream" are used to refer to a direction relative to the direction of airflow 10 through the fan assembly 1.

For purposes of description, it will be assumed that the fan rotational axis 12 extends in a horizontal plane, and the terms "vertical" and "horizontal" are used herein refer to local axes that are perpendicular to the rotational axis 12 and each other, and that extend vertically and horizontally, respectively, relative to the rotational axis 12. It is understood that when the fan assembly 1 is disposed in a vehicle resting on a horizontal surface, the fan assembly 1 may be oriented in space so that the fan rotational axis 12 is angled relative to the "true" horizontal axis. For example, in some vehicles, the fan assembly 1 is oriented in space so that the fan rotational axis 12 is at an angle of ten degrees relative to the "true" horizontal, and during vehicle use over uneven terrain, the fan rotational axis 12 may have an even greater deviation from "true" horizontal. For such "real use" orientations of the fan assembly 1, the local vertical and the local horizontal have a corresponding deviation from the true vertical and true horizontal.

The fan 20 is an axial flow fan that includes a central hub 22 and blades 24 that extend radially outwardly from the hub 22. In some embodiments, the hub 22 and the blades 24 are formed as a single piece, for example in an injection molding process. The hub 22 is cylindrical, and has a curved surface 23 that is parallel to the rotational axis 12. The hub 22 has an upstream end 25 that faces the heat exchanger 14, and an opposed, downstream end 29. Each blade 24 includes a root 26 coupled to the hub curved surface 23, and a tip 28 that is spaced apart from the root 26. The surfaces of each blade 24 have a complex, three-dimensional curvature that is determined by the requirements of the specific application. The fan 20 may be a "banded fan" in which the tips 28 of each blade are joined to a surrounding band (not shown), or alternatively, the band may be omitted whereby the blade tips 28 are referred to as "free," as shown in the illustrated embodiment.

The hub 22 is mechanically connected to the motor 30 in such a way that the fan 20 is driven for rotation about the fan rotational axis 12 by the motor 30, and is supported relative to the shroud 403 by the motor 30.

In the illustrated embodiment, the motor 30 may be, for example, an electrically commutated (EC), brushless DC motor. In other embodiments, the motor 30 may be mechanically commutated via brushes. In the case of an EC motor during fording, the motor 30 may include functionality that detects an "overload" conditions and shuts down. In the case of a brushed motor, when the load becomes greater than the design condition, a fuse "blows" and the motor circuit is de-energized.

In the illustrated embodiment, the shroud 40 is a molded, one-piece structure that provides an airflow passage between the heat exchanger 14 and the fan 20, and supports the fan 20 and motor 30 in a desired position. The shroud 40 includes a plenum 32, a barrel 42 that is connected to a downstream end of the plenum 32, a motor support structure 41 that is supported on an inner surface 43 of the barrel 42 and is configured to support the motor 30 and fan 20 with respect to the plenum 32.

The plenum 32 has a first end 33, and a second end 34 that is downstream from the first end 33. The plenum first end 33 is generally rectangular and is configured to be secured to the heat exchanger 14 or other vehicle structure via known connection techniques and/or using known connectors. The plenum second end 34 is generally conical, and has a minimum cross-sectional dimension at a location distant from the first end 33, whereby the air flow passage defined by the plenum 32 tapers inward along the direction 10 of airflow.

The barrel 42 extends from the second end 34 of the plenum 32 in the downstream direction and at least partially surrounds the fan 20. The barrel 42 is a ring-shaped band having a circular cross-sectional shape. The barrel 42 is concentric with the rotational axis 12.

The motor support structure 41 includes a motor carrier 44 that is disposed inwardly with respect to the barrel 42 and supports the motor 30, and support arms 38 that extend generally radially between the barrel 42 and the motor carrier 44.

The motor carrier 44 is a generally ring-shaped structure that encircles the motor 30. Although the motor carrier 44 is illustrated here as having a generally circular cross-sectional shape when viewed in a section perpendicular to the rotational axis, it is not limited to this configuration, since the cross-sectional shape of the motor carrier 44 may accommodate the profile of the motor 30 that it supports. The motor carrier 44 has a first end 45 that faces upstream, e.g., toward the fan 20, and a second end 46 that is opposed to the first end 45 and that faces downstream, e.g., away from the fan 20. The motor carrier 44 has an outer surface 47 that faces the barrel inner surface 43, and an inner surface 48 that faces the rotational axis 12 and is shaped and dimensioned to accommodate the motor 30. Although the motor carrier 44 is surrounded by the barrel 42 in the illustrated embodiment, it is not limited to this configuration. For example, in some embodiments, the motor carrier 44 may be disposed slightly upstream or downstream from the barrel 42 with respect to the direction 10 of airflow through the fan assembly 1. The motor 30 is supported by the motor carrier 44 in such a way that the fan 20 is disposed upstream of the motor carrier 44 with respect to the direction 10 of air flow through the fan assembly 1.

The support arms 38 support the motor carrier 44 relative to the barrel 42 in such a way that the motor 30 is located in the center region of the barrel 42. To this end, the support arms 38 extend between the motor carrier outer surface 47 and the inner surface 43 of the barrel 42. The support arms 38 are spaced apart along a circumference of the motor carrier 44. In some embodiments, each support arm 38 is a thin beam.

To allow free rotation of the fan 20 relative to the shroud, there is an operating gap 52 between the fan 20, which rotates, and the shroud 40, which does not rotate. The operating gap 52 allows the fan 20 to rotate freely, without friction between the fan 20 and any portion of the shroud 40. The operating gap 52 is an axial gap between the hub 22 and the adjacent motor support structure 41. As used herein, the term "axial" refers to a direction that is parallel to the rotational axis 12. More specifically, the operating gap 52 is disposed between downstream-most portion of the hub 22 (e.g., the hub downstream end 29) and the motor support structure 41, where the operating gap 52 corresponds to the distance between the hub downstream end 29 and the motor support structure 41.

The dimension of the operating gap 52 is a compromise between motor-cooling performance, manufacturing tolerances, and available axial packaging depth. Efficient motor cooling requires the operating gap 52 be sufficiently large so that motor cooling airflow can freely flow through the gap. Manufacturing tolerances favor a "large" operating gap 52 to minimize the possibility of unintended contact between warped or misshapen components during normal operation of the fan assembly 1. On the other hand, axial package depth of the fan assembly 1 is typically limited so the operating gap 52 cannot be made arbitrarily large.

A protrusion 80 is provided on the first end 45 of the motor carrier 44. The protrusion 80 has a first end 81, and a second end 82 that is opposed to the first end 81. The protrusion 80 has a center 83 mid way between the first end 81 and the second end 82. The protrusion 80 protrudes axially, e.g. toward the fan 20 along an axis that is parallel to the rotational axis 12, so as to extend into the operating gap 52. Due at least to the presence of the protrusion 80 in the operating gap 52, the operating gap 52 has a non-uniform dimension about a circumference of the downstream end 29 of the hub 22. Moreover, the protrusion is dimensioned so that the dimension of the operating gap 52 is a minimum at the protrusion 80.

The protrusion 80 serves to define a clearance gap 50 between the motor carrier 44 and the fan hub 22 that limits the extent of deflection of the fan 20 during a water fording event, since the protrusion 80 is configured to provide the point of contact between the hub 22 and the motor carrier 44 during fording and before the fan blade can deflect sufficiently far upstream to contact the heat-exchanger. Via this direct contact between the upstream end, or contact surface 84, of the protrusion 80 and the hub downstream end 29, the shroud 40, including the motor support structure 41, adds mechanical support to the fan 20.

More specifically, the clearance gap 50 is disposed between the protrusion 80 and the hub 22, where a dimension of the clearance gap 50 corresponds to an axial distance between the protrusion contact surface 84 and the hub downstream end 29. In some embodiments, the clearance gap 50 is less than 50 percent of the average operating gap 52 at locations outside the clearance gap 50. In other embodiments, the clearance gap 50 is less than 40 percent of the average operating gap 52 at locations outside the clearance gap 50. In still other embodiments, the clearance gap 50 is less than 30 percent of the average operating gap 52 at locations outside the clearance gap 50. In still other embodiments, the clearance gap 50 is less than 20 percent of the average operating gap 52 at locations outside the clearance gap 50. In still other embodiments, the clearance gap 50 is less than 10 percent of the average operating gap 52 at locations outside the clearance gap 50.

In the illustrated embodiment, the protrusion 80 is elongated in that the protrusion 80 has a length dimension 90 (e.g., a distance between the protrusion first and second ends 81, 82) that is much greater than the radial dimension 92 or axial dimension 94 of the protrusion 80. For example, in the illustrated embodiment, the length dimension 90 may be ten times the axial and radial dimensions 92, 94 or more. By providing the protrusion 80 that is elongated in the direction of rotation, the friction-inducing surface area of the contact surface 84 is extended so that the protrusion 80 can provide an effective braking action that may slow the fan's rotational speed.

The protrusion 80 extends continuously along a curved path. In the illustrated embodiment, the curved path corresponds to a peripheral edge 49 of the motor carrier 44, while in other embodiments, the protrusion 80 is disposed on the first end 45 of the motor carrier 44 at a location that is spaced apart from the motor carrier peripheral edge 49.

The protrusion 80 is disposed at a location that will minimize the extent of deflection of the fan 20 during a water fording event. In the illustrated fan assembly 1, during a water fording event in which the lower portion of the fan 20 is submerged, a deflection of the hub 22 may occur in which the hub 22 pivots about a horizontal pivot axis 18

(shown as a point in FIG. 15) that is generally perpendicular to, and intersects or nearly intersects, the rotational axis 12. The pivoting deflection of the hub 22 acts to increase the axial operating gap 52 between the hub 22 and the motor carrier 44 at locations below the pivot axis 18 and decrease the operating gap between the hub 22 and the motor carrier 44 at locations above the pivot axis 18. For this reason, the protrusion 80 is located in a predefined region 60 of the operating gap 52.

Figure 1:
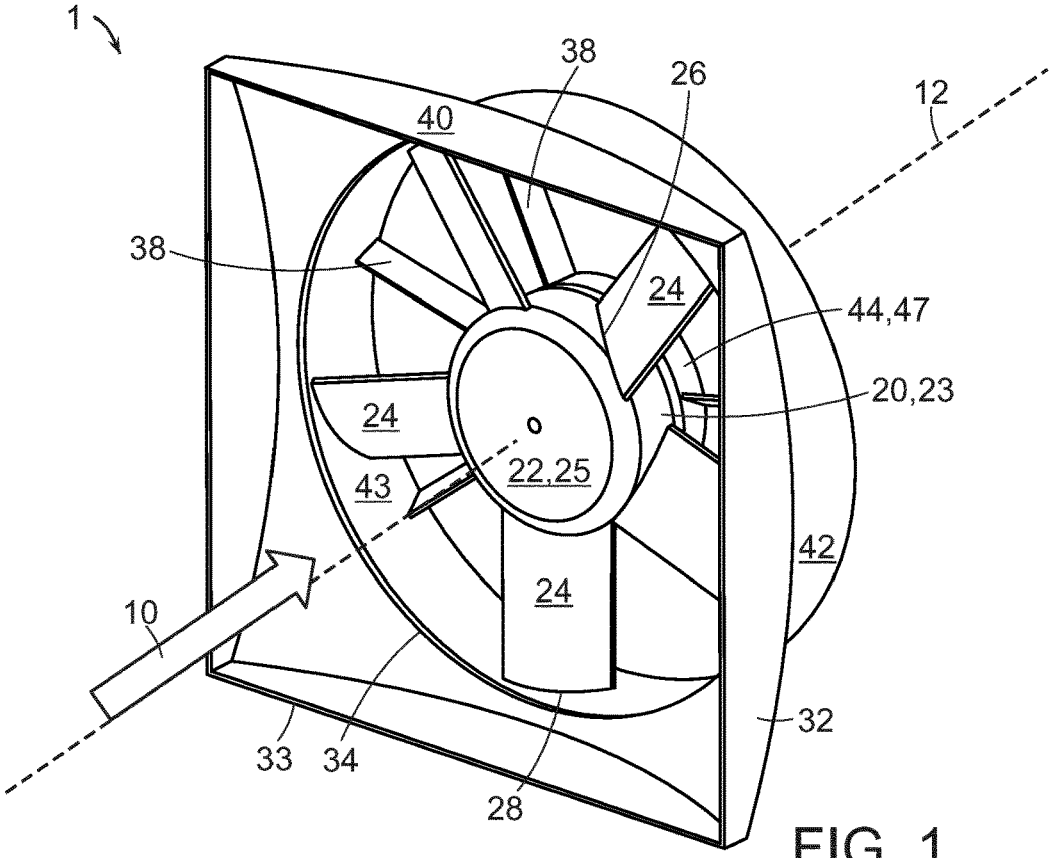
FIG. 1 is a perspective view of a fan assembly.
Figure 2:
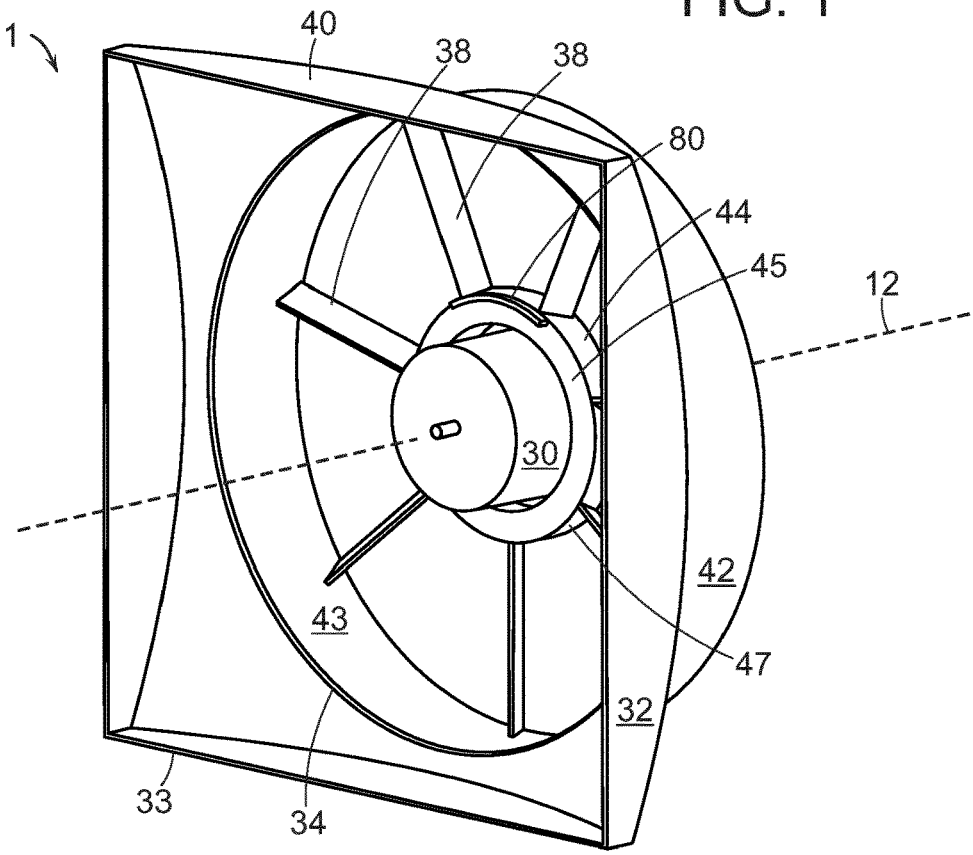
FIG. 2 is a perspective view of the fan assembly of FIG. 1, shown with the fan omitted.
Figure 3:
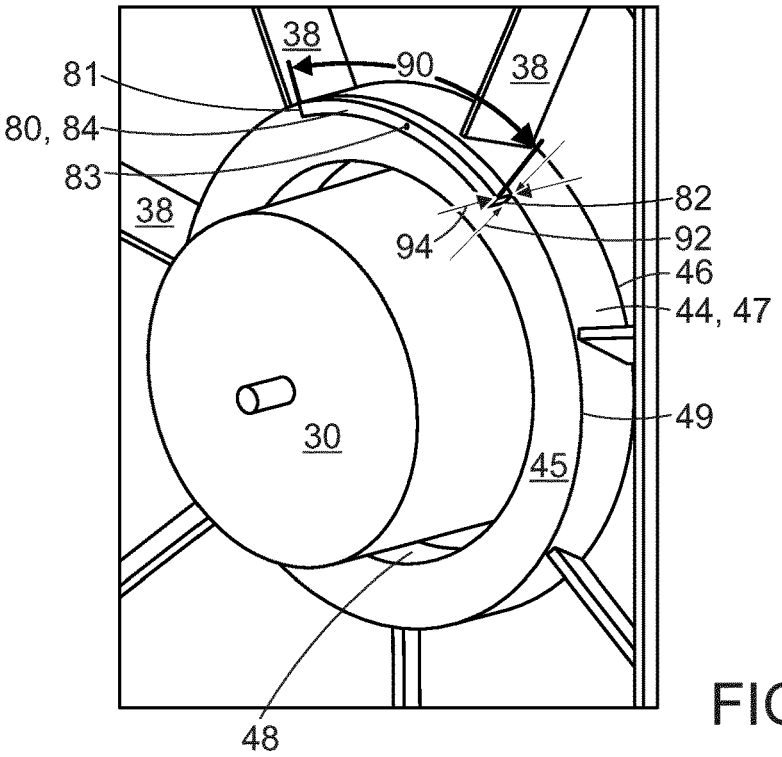
FIG. 3 is an enlargement of a portion of FIG. 2.
Figure 4:
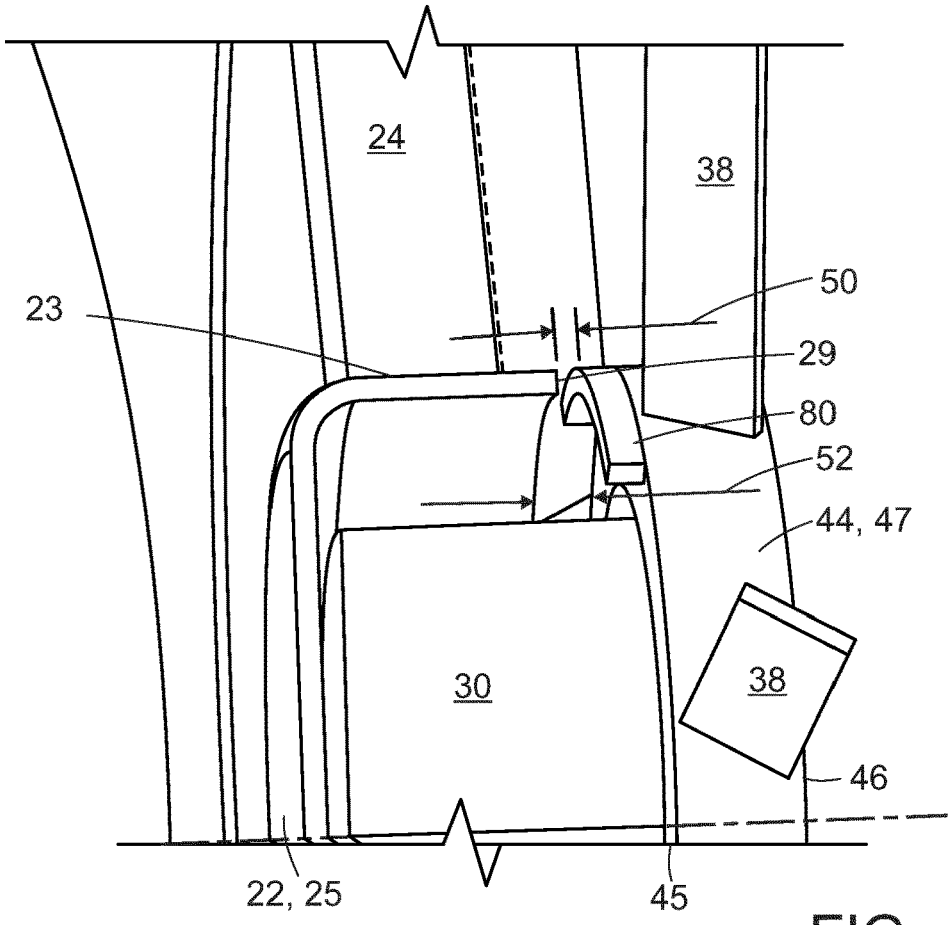
FIG. 4 is a perspective detail view of a portion of the fan assembly of FIG. 1.
Figure 5:
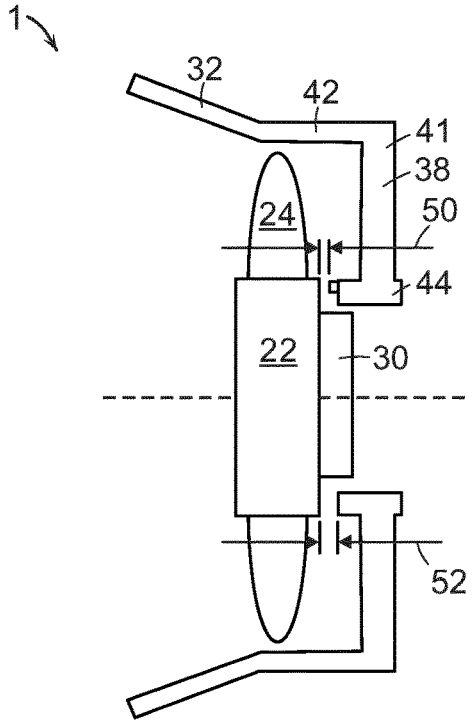
FIG. 5 is a schematic cross-sectional view of the fan assembly of FIG. 1.
Figure 6:
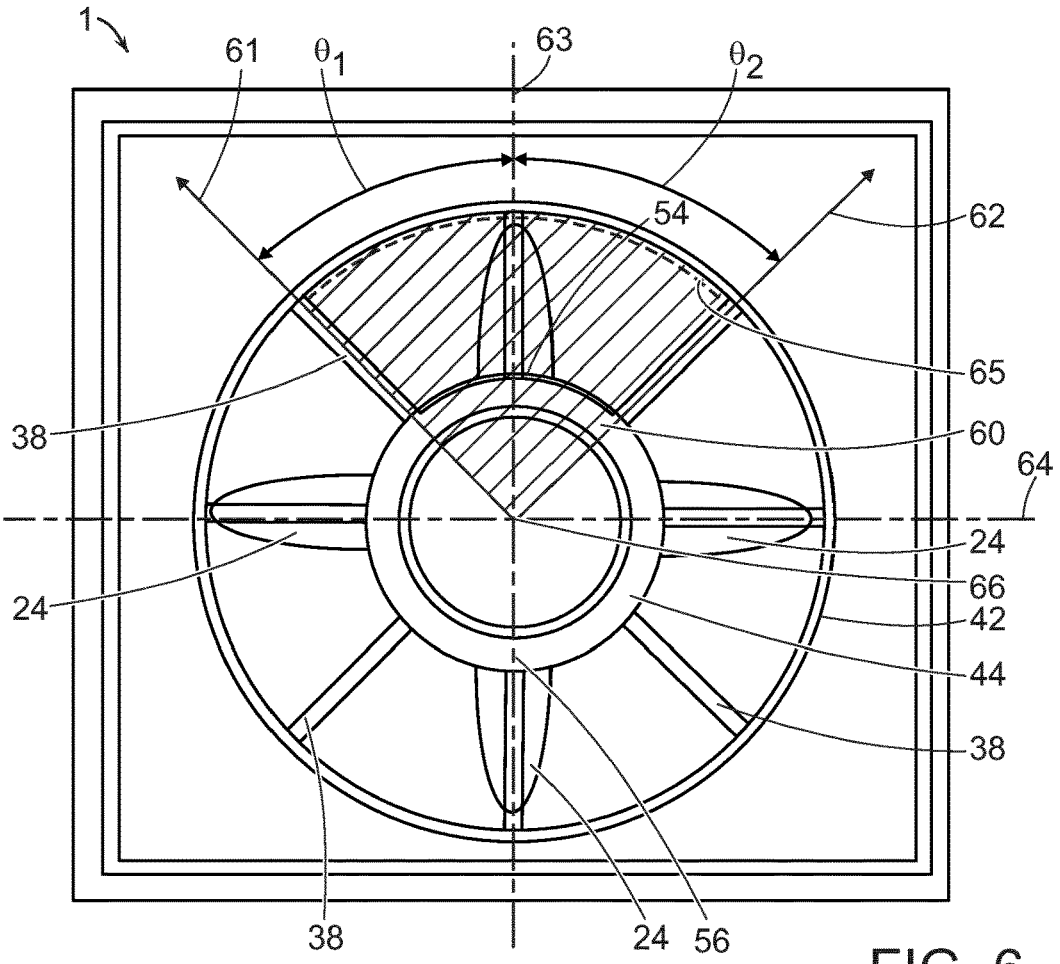
FIG. 6 is an end view of the fan assembly of FIG. 1 illustrating the predefined region and the local vertical and horizontal axes.

Referring to FIG. 6, the predefined region 60 has a sector shape that is bounded by a first sector ray 61, a second sector ray 62, and a circular sector arc 65 that extends between the first and second sector rays 61, 62. An apex 66 of the sector shape corresponds to an intersection of the first and second sector rays 61, 62. The apex 66 coincides with the rotational axis 12. The predefined region 60 overlaps a vertical axis 63 that is disposed in the operating gap 52 and intersects the rotational axis 12. The first sector ray 61 is at first angle θ1 relative to the vertical axis 63, and the second sector ray 62 is at a second angle θ2 relative to the vertical axis 63.

In some embodiments, the first sector ray 61 passes through the protrusion first end 81, and the second sector ray 62 passes through the protrusion second end 82, while in other embodiments, the protrusion first and second ends 81, 82 are spaced apart from the first and second sector rays 61, 62.

The protrusion 80 is disposed in the predefined region 60 so as to extend across the upper-most azimuthal position 54. In some embodiments, the center 83 of the protrusion 80 overlies (e.g., is axially aligned with) the upper-most azimuthal position 54. In other words, the protrusion 80 is disposed at a location corresponding to a top center position or upper-most azimuthal position 54 of the motor carrier first end 45. The upper-most azimuthal position 54 corresponds to a location at which the carrier first end 45 faces (e.g., is axially aligned with) the vertical axis 63. In addition, the protrusion is located at the furthest extent of the motor carrier first end 45 from the rotational axis 12 (pivot axis 18).

In the schematic illustration of the predefined region 60 shown in FIG. 6, the predefined region 60 is above a horizontal axis 64 that intersects the rotational axis 12 and vertical axis 63. In addition, the first angle θ1 is at −45 degrees and the second angle θ2 at +45 degrees, as measured from the vertical axis 63. The first and second angles θ1, θ2 are determined by the requirements of the specific application. In some embodiments, first angle θ1 is in a range of −90 degrees to 0 degrees, and the second angle θ2 is in a range of 0 degrees to +90 degrees. In other embodiments, first angle θ1 is in a range of −45 degrees to 0 degrees, and the second angle θ2 is in a range of 0 degrees to +45 degrees. In still other embodiments, first angle θ1 is in a range of −30 degrees to 0 degrees, and the second angle θ2 is in a range of 0 degrees to +30 degrees. In still other embodiments, first angle θ1 is in a range of −10 degrees to 0 degrees, and the second angle θ2 is in a range of 0 degrees to +10 degrees. In still other embodiments, first angle θ1 is in a range of −5 degrees to 0 degrees, and the second angle θ2 is in a range of 0 degrees to +5 degrees. In still other embodiments, first angle θ1 is in a range of −1 degree to 0 degrees, and the second angle θ2 is in a range of 0 degrees to +1 degree. In still other embodiments, first angle θ1 is in a range of −90 degrees to −45 degrees, and the second angle θ2 is in a range of −40 degrees to 0 degrees. In still other embodiments, first angle θ1 is in a range of 0 degrees to 40 degrees, and the second angle θ2 is in a range of 45 degrees to 90 degrees. In some embodiments, an absolute value of the first angle θ1 is greater than an absolute value of the second angle θ2. In other embodiments, an absolute value of the first angle θ1 is less than an absolute value of the second angle θ2.

In some embodiments, the center 83 of the protrusion 80 is offset from the upper-most azimuthal position 54. For example, in embodiments in which the fan 20 rotates in a clockwise direction, the protrusion center 83 may be offset from the upper-most azimuthal position 54 in a clockwise direction, such as is shown in FIGS. 1-4. Likewise, in embodiments in which the fan 20 rotates in a counter-clockwise direction, the protrusion center 83 may be offset from the upper-most azimuthal position 54 in the counter-clockwise direction.

Figure 7:
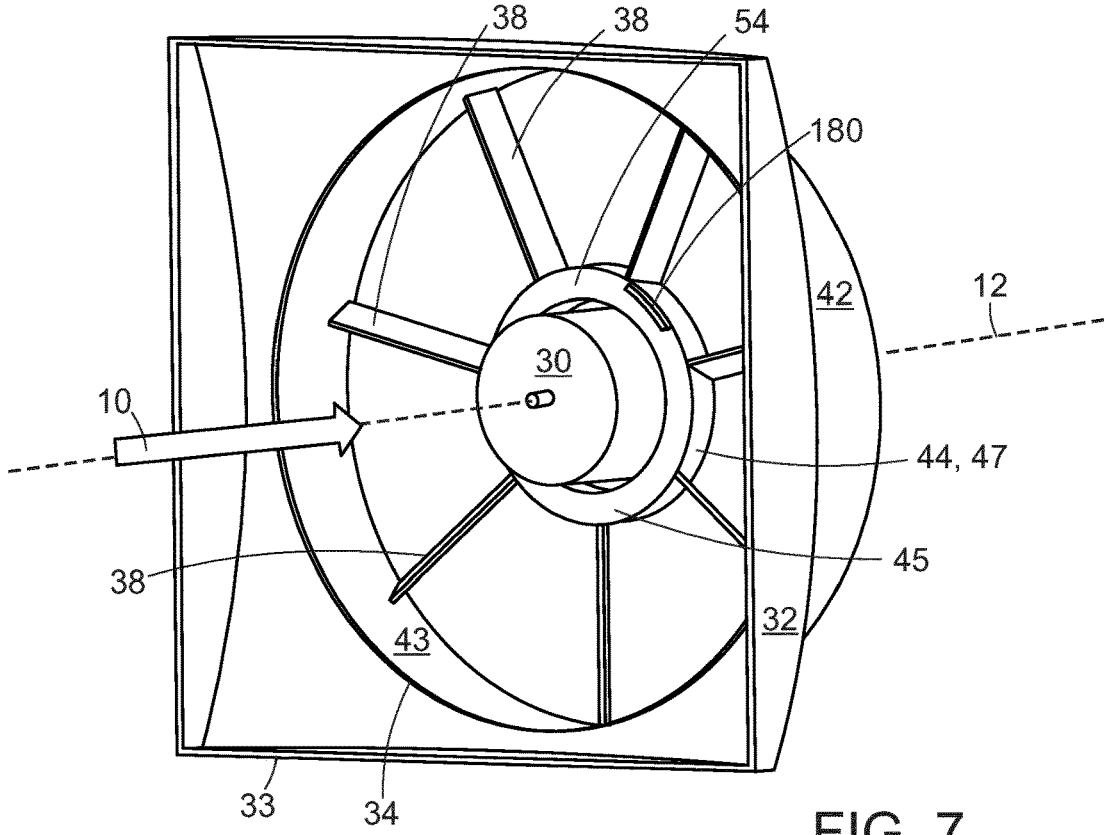
FIG. 7 is a perspective view of the fan assembly including an alternative embodiment protrusion, shown with the fan omitted.

Referring to FIG. 7, although the protrusion 80 is illustrated as extending across the upper-most azimuthal position 54, the protrusion 80 is not limited to this configuration. For example, in some embodiments, an alternative embodiment protrusion 180 may be offset relative to the upper-most azimuthal position 54.

Figure 8:
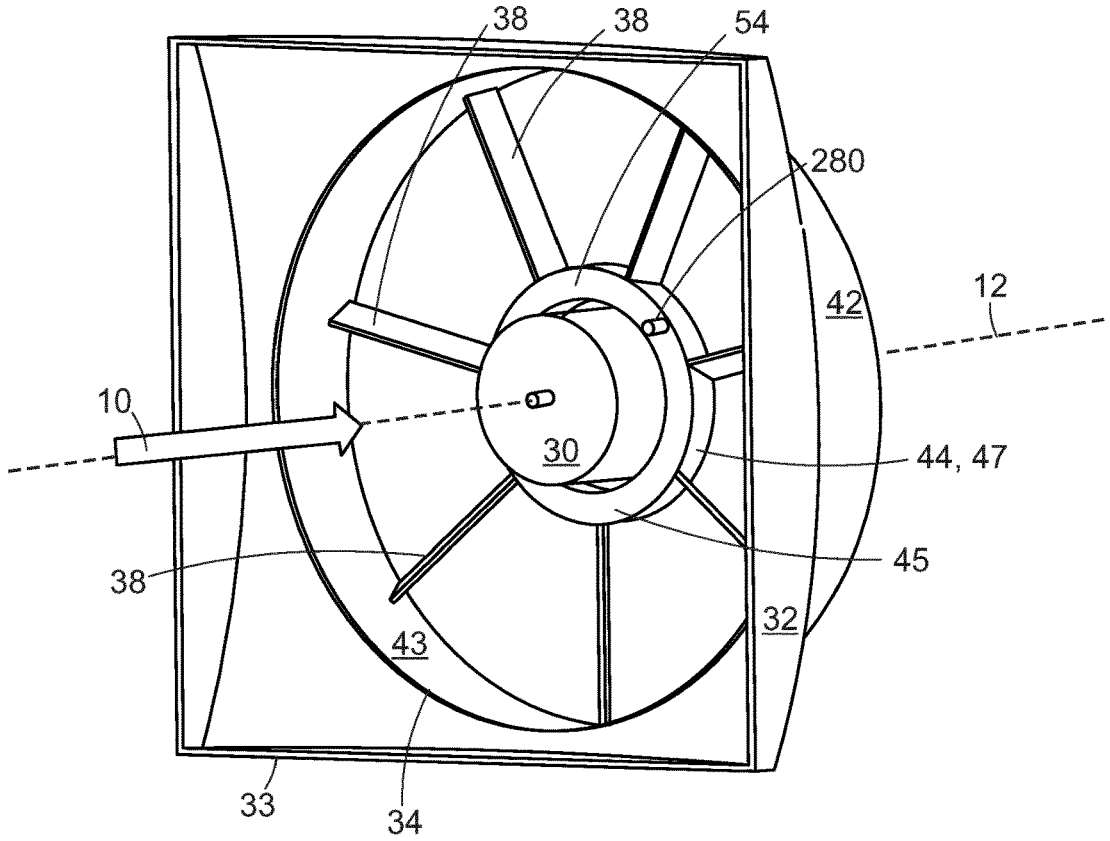
FIG. 8 is a perspective exploded view of the fan assembly including another alternative embodiment protrusion, shown with the fan omitted.

Although the protrusion 80 is illustrated as being elongated, and extending along an arc shaped path, the protrusion 80 is not limited to this configuration. For example, in some embodiments, the protrusion 80 may extend along a linear path. In other embodiments, the protrusion 80 may not be elongated and instead may have a cylindrical shape. For example, another alternative protrusion 280 may have the appearance of an axially protruding post (FIG. 8).

Figure 9:
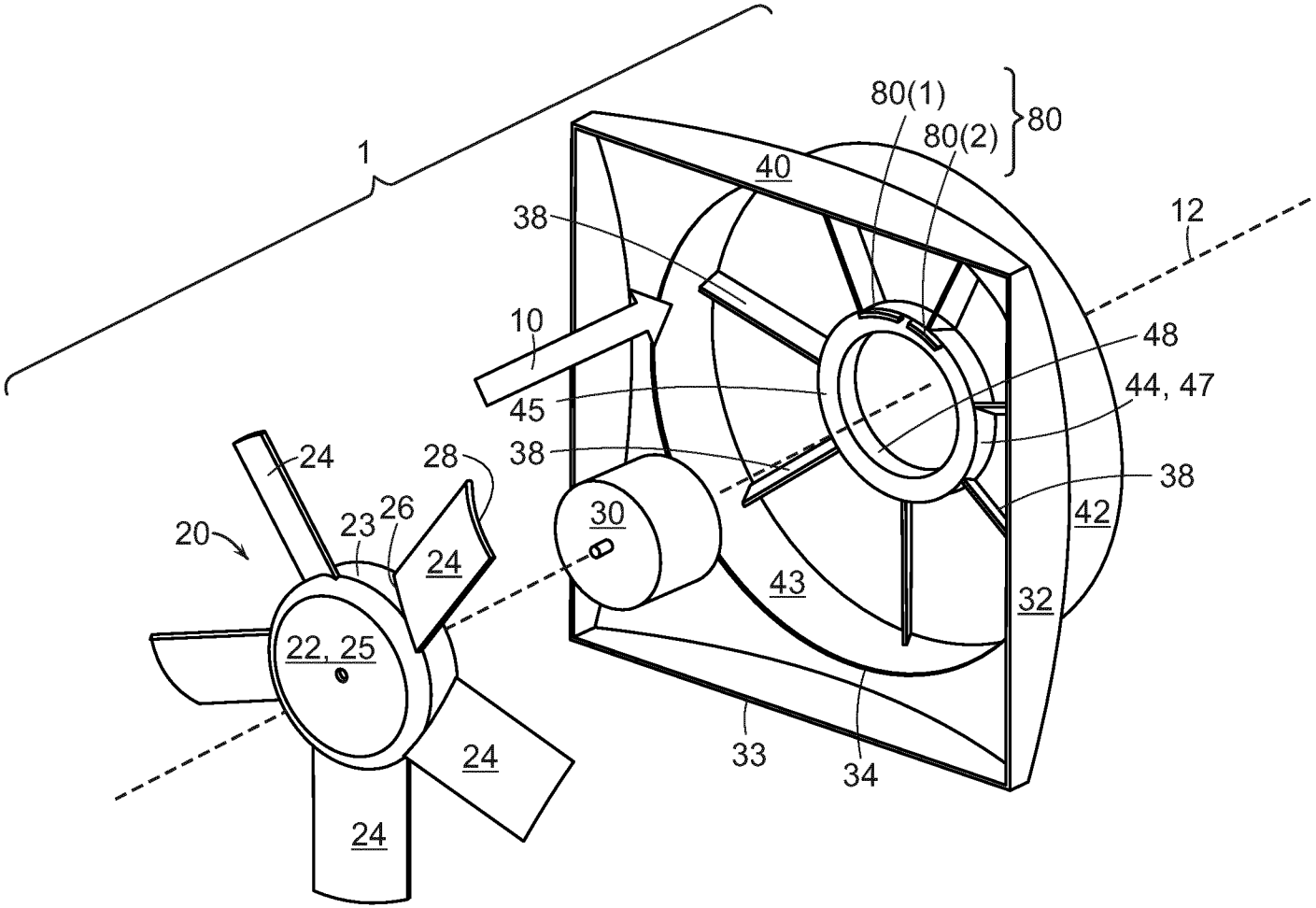
FIG. 9 is a perspective exploded view of the fan assembly including still another alternative embodiment protrusion.
Figure 10:
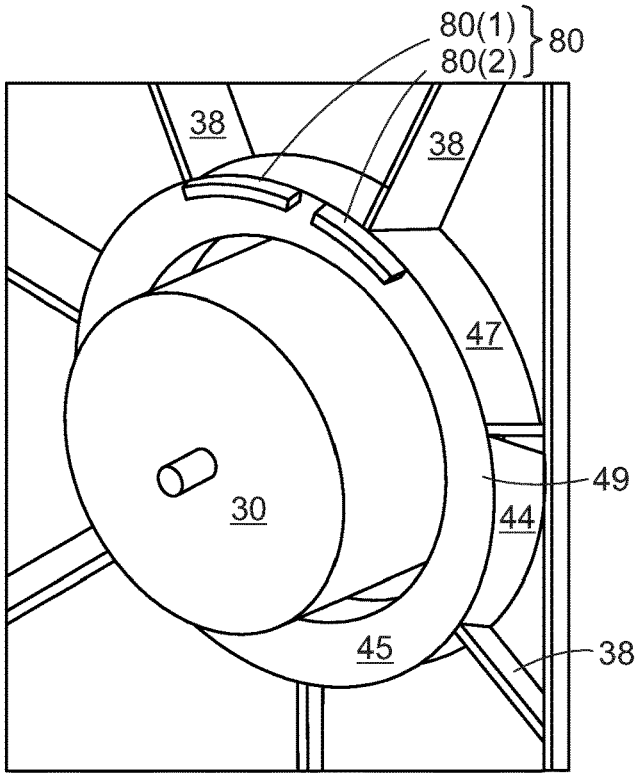
FIG. 10 is an enlargement of a portion of the fan assembly of FIG. 9.

Referring to FIGS. 9 and 10, the protrusion 80 is not limited to being a single, continuous structure. For example, in some embodiments the protrusion 80 be discontinuous along its length, for example to accommodate ancillary structures of the motor carrier 44 such as fastener openings (not shown). In this embodiment, the protrusion 80 includes a first portion 80(1) and a second portion (2) that is spaced apart from the first portion 80(1) along the curved path.

In the embodiments described above, in which the fan 20 is disposed upstream with respect to the motor support structure 41, the protrusion 80 is illustrated as being located at the upper-most azimuthal position 54. However, in some alternative fan assemblies 100, the motor support structure 41 may be located upstream with respect to the fan 20.

Figure 11:
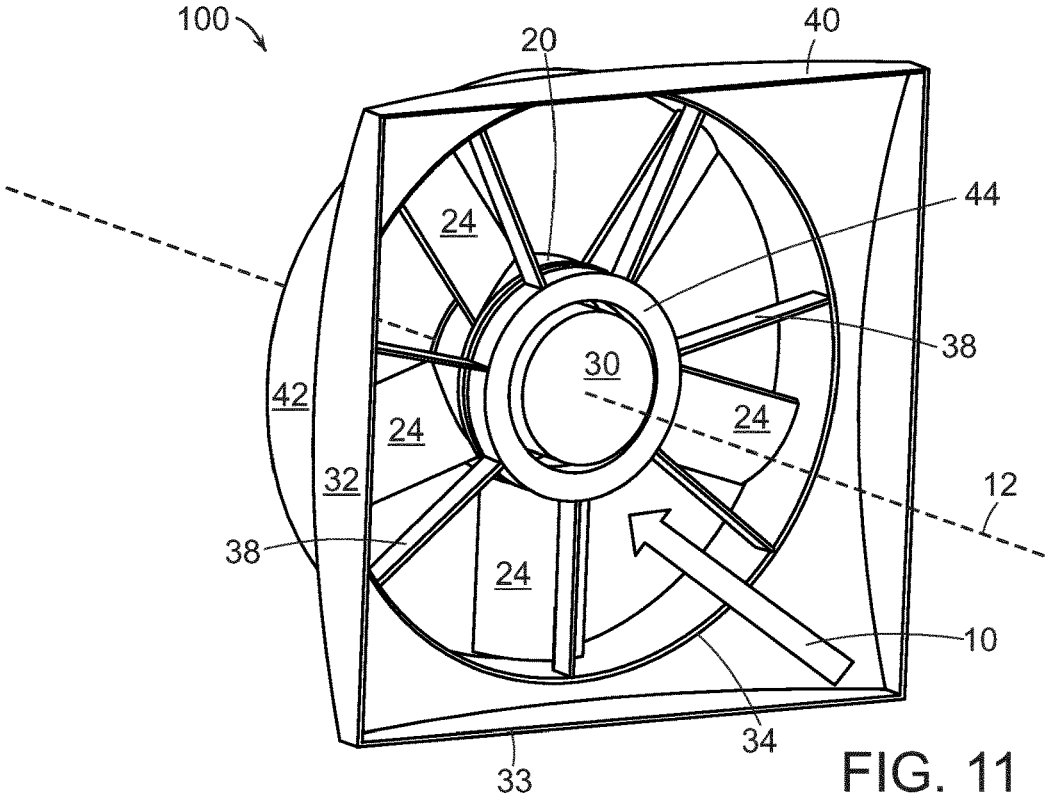
FIG. 11 is a perspective view of an alternative embodiment fan assembly.
Figure 12:
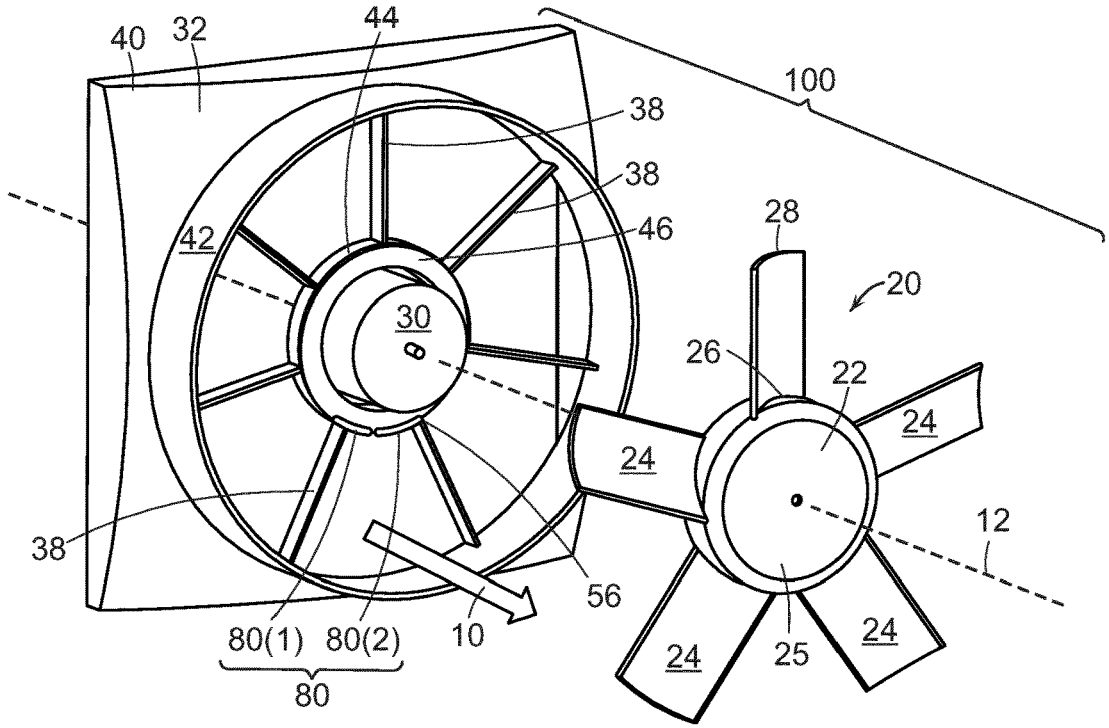
FIG. 12 is an exploded view of the fan assembly of FIG. 11.

Referring to FIGS. 11 and 12, a fan assembly 100 in which the motor support structure 41 is located upstream with respect to the fan 20 is shown. During a water fording event in which the lower portion of the fan 20 is submerged, a pivoting deflection of the hub 22 acts to decrease the axial operating gap 52 between the hub 22 and the motor carrier 44 at locations below the pivot axis and increase the operating gap between the hub 22 and motor carrier 44 at locations above the pivot axis 18. For this reason, the protrusion 80 is located at the lowest extent of the motor carrier first end 45. In other words, the protrusion 80 is disposed at a location corresponding to a lower-most azimuthal position 56 of the motor carrier first end 45. The lower-most azimuthal position 56 corresponds to a location at which the carrier first end 45 faces (e.g., is axially aligned with) the vertical line 63 that passes through the rotational axis 12.

Figure 13:
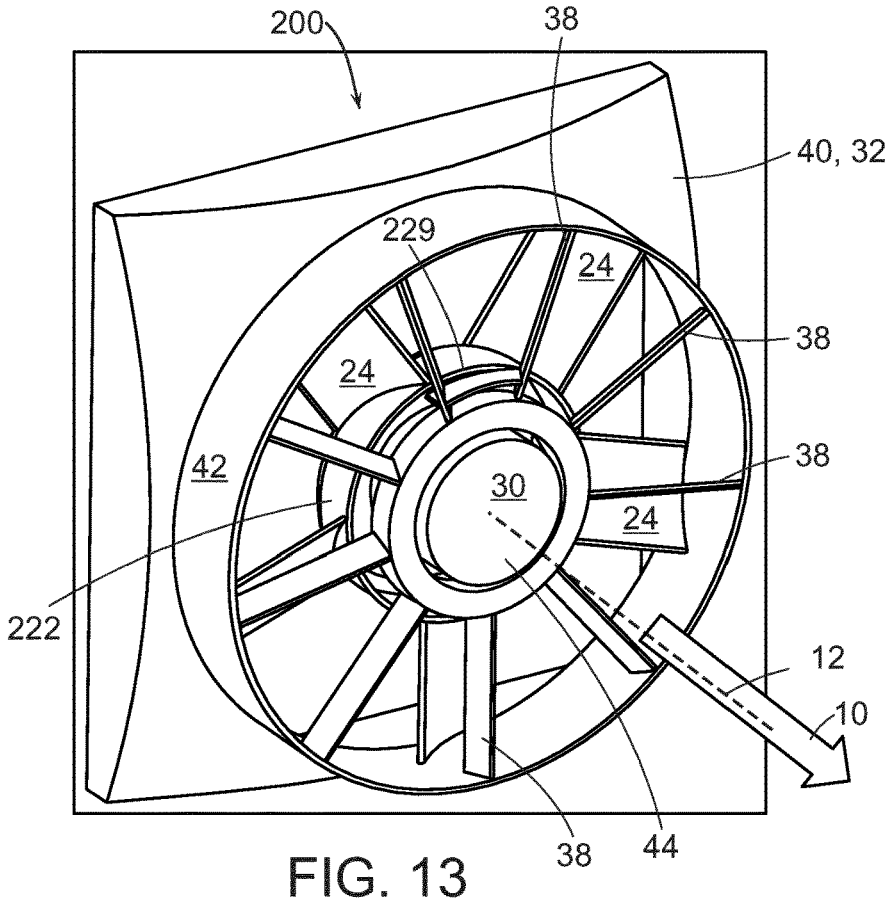
FIG. 13 is a perspective view of another alternative embodiment fan assembly.
Figure 14:
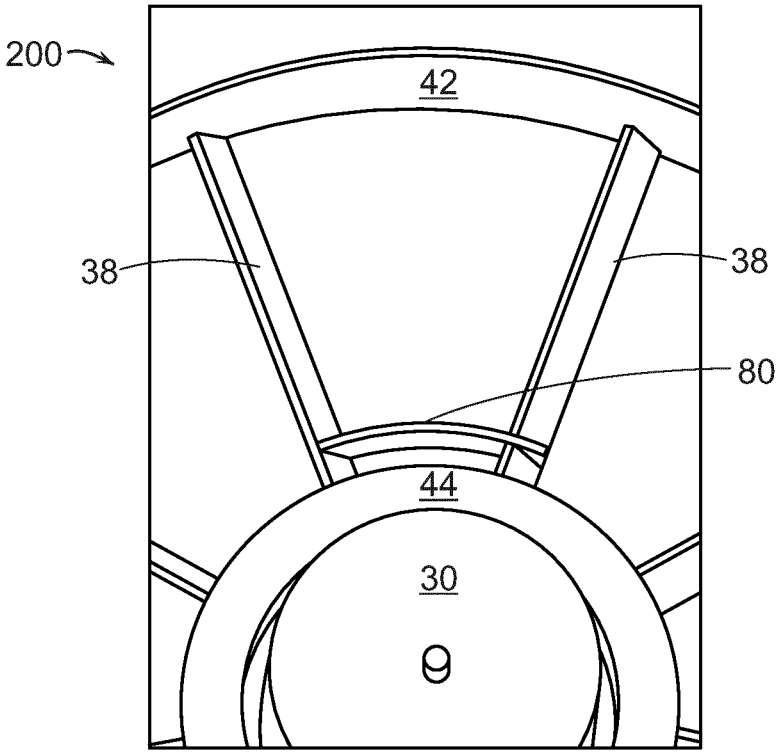
FIG. 14 is an enlarged view of a portion of the fan assembly of FIG. 13.

In the above described embodiments, the diameter of the hub 22 is generally equal to or less than a diameter of the motor carrier 44. In such embodiments, the protrusion is provided on the motor carrier 44, and the clearance gap distance is measured between the downstream end 29 of the hub 22 and the upstream end of protrusion 80. In other embodiments, the diameter of the hub 22 may be greater than a diameter of the motor carrier 44. For example, referring to FIGS. 13 and 14, an alternative embodiment fan assembly 200 is similar to the fan assembly 1 described above, and common reference numbers are used to refer to common elements. The fan assembly 200 differs from the fan assembly 1 in that a diameter of the fan hub 222 is greater than a diameter of the motor carrier 44. In the fan assembly 200, the protrusion 80 is provided on the fan-facing ends 39 of the support arms 38 rather than the motor carrier 44 so as to face, and be axially aligned with, the downstream end 229 of the hub 222. In the illustrated embodiment, the protrusion 80 has sufficient length 90 to extend across two adjacent support arms 38*a*, 38*b*. In this embodiment, the clearance gap distance is measured between the downstream end 29 of the hub 22 and the upstream end 84 of the protrusion 80.

When the fan assembly 1 encounters water during a water fording event, the upstream axial deflection of the submerged portion of the fan 20 is limited because the protrusion contacts the hub 22, whereby the stationary shroud structure adds mechanical support to the fan 20. Additionally, the friction created by the contact between the rotating fan 20 and the protrusion 80 provided on the shroud motor-support structure 44 provides braking action that may slow the fan's rotational speed. Since the axial force is proportional to the square of the fan speed, this contact acts to further limit the upstream axial deflection of the submerged portion of the fan 20.

The protrusion 80 creates an intentionally limiting axial clearance gap 50 in the vicinity of the upper-most azimuth of the corresponding motor support structure, whereby the risk of the fan 20 contacting and damaging the vehicle heat-exchanger 14 is reduced.

By designing the protrusion 80 to limit the axial clearance gap 50 so that contact between the hub 22 and the protrusion 80 of the motor su ort structure 41 occurs during fording and before the fan blade 24 can deflect sufficiently far upstream to contact the heat exchanger 14, and by limiting the circumferential extent of the protrusion 80, the deleterious effects (such as insufficient motor cooling, or increased possibility of rubbing during normal operation) of a too small axial clearance gap is minimized.

Figure 16:
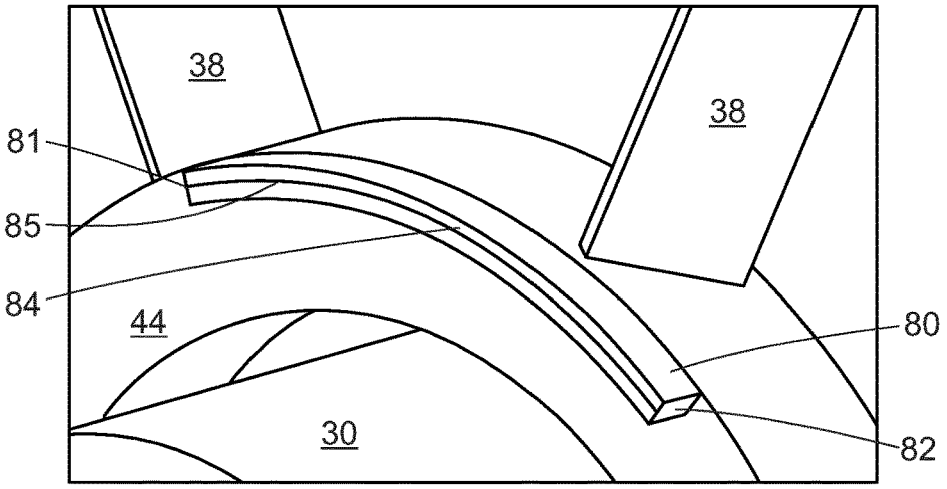
FIG. 16 is an enlarged view of a portion of the fan assembly of FIG. 1, illustrating a groove disposed on the contact surface of the protrusion.
Figure 17:
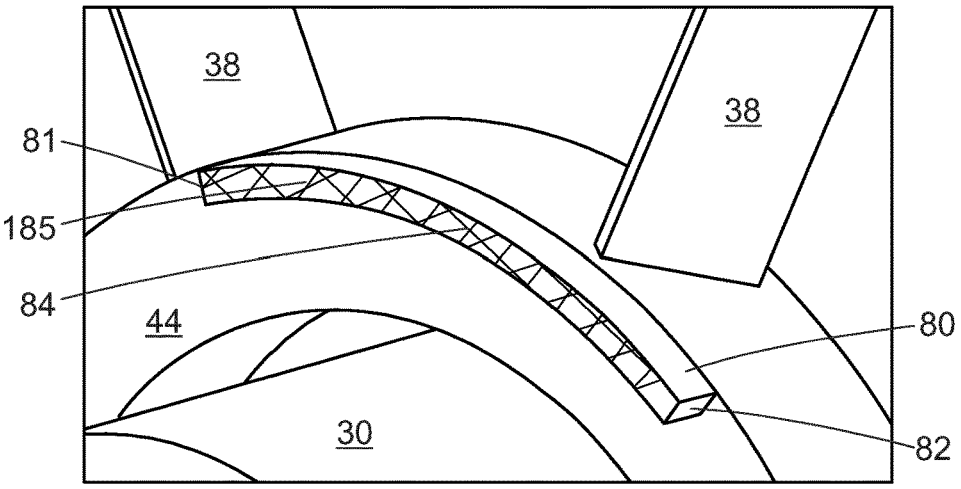
FIG. 17 is an enlarged view of a portion of the fan assembly of FIG. 1, illustrating knurling disposed on the contact surface of the protrusion.
Figure 18:
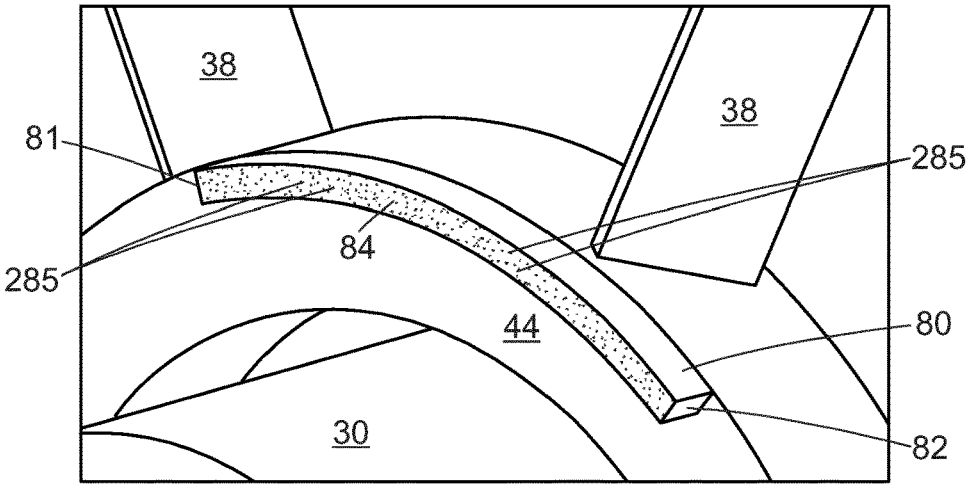
FIG. 18 is an enlarged view of a portion of the fan assembly of FIG. 1, illustrating abrasive particles disposed on the contact surface of the protrusion.

Referring to FIGS. 16-18, in some embodiments, the contact surface 84 of the protrusion 80 may include surface features. In some embodiments, the surface features are configured to facilitate shedding of water from the contact surface. In such embodiments, the surface features may include one or more grooves 85 that direct water away from the contact surface 84 (FIG. 16). Although in the illustrated embodiment, the surface feature is a single groove 85 that extends along the length of the contact surface 84, the groove 85 is not limited to this configuration. For example, there may be multiple grooves 85, and the grooves may have the shape of chevrons or other flow-facilitating configurations. In other embodiments, the surface features are configured to facilitate the braking effect provided by the protrusion 80. To this end, the surface features may be configured to provide increased roughness of the contact surface. In some embodiments, the contact surface has a surface roughness that is greater than a surface roughness of the motor support structure 44. In some embodiments, this may be achieved by providing surface features that consist of one or more of knurls 185 (FIG. 17), stipples, dimples or other appropriate structures. In other embodiments, this may be achieved by providing an abrasive coating including abrasive particles 285 (FIG. 18) on the contact surface 84.

Selective illustrative embodiments of the fan assembly are described above in some detail. It should be understood that only structures considered necessary for clarifying the fan assembly have been described herein. Other conventional structures, and those of ancillary and auxiliary components of the fan assembly are assumed to be known and understood by those skilled in the art. Moreover, while working examples of the fan assembly have been described above, the fan assembly is not limited to the working examples described above, but various design alterations may be carried out without departing from the fan assembly as set forth in the claims.

What is claimed is:

1. An automotive cooling fan assembly comprising:

a motor;

a fan that is driven by the motor to rotate about a rotational axis, the fan including a cylindrical hub having a first end, a second end, and a curved surface that is parallel to the rotational axis and extends between the first and second ends, and blades disposed along a circumference of the curved surface, the blades protruding radially outward from the hub with respect to the rotational axis; and a shroud that supports the motor, the shroud including a barrel that at least partially surrounds the fan and is concentric with the rotational axis, and a motor support structure that extends from the barrel and supports the motor, wherein an operating gap is disposed between an end of the hub and the motor support structure, where a dimension of the operating gap corresponds to an axial distance between the end of the hub and the motor support structure, where the term axial refers to a direction that is parallel to the rotational axis, the motor support structure includes a protrusion that protrudes axially into the operating gap, the protrusion spanning less than 360 degrees relative to the rotational axis, and the dimension of the operating gap is a minimum at the protrusion.

2. The assembly of claim 1, wherein a clearance gap is disposed between the protrusion and the motor support structure, where a dimension of the clearance gap corresponds to an axial distance between the protrusion and the end of the hub, and the clearance gap is less than 50 percent of an average operating gap at locations outside the clearance gap.

3. The assembly of claim 1, wherein a clearance gap is disposed between the protrusion and the motor support structure, where a dimension of the clearance gap corresponds to an axial distance between the protrusion and the end of the hub, and the clearance gap is less than 40 percent of an average operating gap at locations outside the clearance gap.

4. The assembly of claim 1, wherein a clearance gap is disposed between the protrusion and the motor support structure, where a dimension of the clearance gap corresponds to an axial distance between the protrusion and the end of the hub, and the clearance gap is less than 30 percent of an average operating gap at locations outside the clearance gap.

5. The assembly of claim 1, wherein a clearance gap is disposed between the protrusion and the motor support structure, where a dimension of the clearance gap corresponds to an axial distance between the protrusion and the end of the hub, and the clearance gap is less than 20 percent of an average operating gap at locations outside the clearance gap.

6. The assembly of claim 1, wherein a clearance gap is disposed between the protrusion and the motor support structure, where a dimension of the clearance gap corresponds to an axial distance between the protrusion and the end of the hub, and the clearance gap is less than 10 percent of an average operating gap at locations outside the clearance gap.

7. The assembly of claim 1, wherein the motor support structure comprises a motor carrier that is disposed inwardly with respect to the barrel and supports the motor, and support arms that extend between the barrel and the motor carrier, and the protrusion is disposed on the motor carrier.

8. The assembly of claim 1, wherein the motor support structure comprises a motor carrier that is disposed inwardly with respect to the barrel and supports the motor, and support arms that extend between the barrel and the motor carrier, and the protrusion is disposed on a support arm.

9. The assembly of claim 1, wherein the protrusion is disposed in a predefined region of the operating gap, where the predefined region ii) has a sector shape that is bounded by a first sector ray, a second sector ray, and a circular sector arc, an apex of the sector shape corresponding to an intersection of the first sector ray and the second sector ray, the apex coinciding with the rotational axis, and ii) overlaps a vertical line that is disposed in the operating gap and intersects the rotational axis, and wherein the first sector ray is at a first angle relative to the vertical axis, the second sector ray is at a second angle relative to the vertical axis, the circular arc extends between the first sector ray and the second sector ray, the first angle is in a range of −90 degrees to 0 degrees, and the second angle is in a range of 0 degrees to +90 degrees.

10. The assembly of claim 9, wherein the motor support structure is disposed downstream relative to the fan, and the predefined region is positioned within the operating gap at a location that corresponds to an upper-most azimuthal position.

11. The assembly of claim 9, wherein the motor support structure is disposed upstream of the fan, and the predefined region is positioned within the operating gap at a location that corresponds to a lower-most azimuthal position.

12. The fan assembly of claim 9, wherein the first angle is in a range of −45 degrees to 0 degrees, and the second angle is in a range of 0 degrees to +45 degrees.

13. The fan assembly of claim 9, wherein an absolute value of the first angle is different than an absolute value of the second angle.

14. The fan assembly of claim 1, wherein the motor support structure comprises a motor carrier that is disposed inwardly with respect to the barrel and supports the motor, and support arms that extend between the barrel and the motor carrier, and the protrusion protrudes from a fan-facing surface of the motor carrier.

15. The fan assembly of claim 14, wherein the protrusion is elongated along a curved path.

16. The fan assembly of claim 14, wherein at least a portion of the protrusion coincides with a peripheral edge of the motor carrier.

17. The fan assembly of claim 14, wherein a center of the protrusion is axially aligned with one of an upper-most azimuthal position of the motor carrier and a lower-most azimuthal position of the motor carrier.

18. The fan assembly of claim 14, wherein the protrusion at least partially overlies one of an upper-most azimuthal position of the motor carrier and a lower-most azimuthal position of the motor carrier, and a center of the protrusion is offset relative to the one of an upper-most azimuthal position of the motor carrier and a lower-most azimuthal position of the motor carrier.

19. The assembly of claim 14, wherein the protrusion is discontinuous along the fan-facing surface of the motor carrier.

20. The assembly of claim 14, wherein the protrusion is an axially extending post.

21. The assembly of claim 20, wherein the post is cylindrical.

22. The assembly of claim 1, wherein the protrusion includes a contact surface that faces the hub, the contact surface including surface features that are configured to facilitate shedding of water from the contact surface.

23. The assembly of claim 22, wherein the surface features include grooves.

24. The assembly of claim 1, wherein the protrusion includes a contact surface that faces the hub, the contact surface having a surface roughness that is greater than a surface roughness of the motor support structure.

25. The assembly of claim 24, wherein the contact surface includes surface features, the surface features include at least one of knurling, stippling, and dimpling.

* * * * *